US006047761A

United States Patent [19]

Jaehnen et al.

[11] Patent Number: 6,047,761

[45] Date of Patent: Apr. 11, 2000

[54] UNIVERSAL OVERHEAD DOOR SYSTEM

[75] Inventors: Edwin C. Jaehnen, Cincinnati; Richard J. Lewis, Jr., Loveland; Kenneth E. Carper, Cincinnati; Bob Bailey, Trenton, all of Ohio

[73] Assignee: Clopay Building Products Company Inc., Cincinnati, Ohio

[21] Appl. No.: 09/149,214

[22] Filed: Sep. 8, 1998

[51] Int. Cl.[7] ..... E05F 1/00

[52] U.S. Cl. ..... 160/201; 160/209

[58] Field of Search ..... 160/201, 209, 160/207, 229.1, 40

[56] References Cited

U.S. PATENT DOCUMENTS

| | | | |
|---|---|---|---|
| 1,012,849 | 12/1911 | Hedwall . | |
| 1,200,639 | 10/1916 | Moore et al. . | |
| 1,990,870 | 2/1935 | Kelly . | |
| 2,032,768 | 3/1936 | Rowe . | |
| 2,045,060 | 6/1936 | Wheatley . | |
| 2,059,585 | 11/1936 | Kelly | 160/209 |
| 2,064,470 | 12/1936 | Heckman . | |
| 2,075,716 | 3/1937 | Harrison . | |
| 2,251,139 | 8/1941 | Schlacter . | |
| 2,264,642 | 12/1941 | Rowe . | |
| 2,266,707 | 12/1941 | Goodman . | |
| 2,329,443 | 9/1943 | Rowe . | |
| 2,330,670 | 9/1943 | Black . | |
| 2,391,845 | 12/1945 | Rowe . | |
| 2,436,006 | 2/1948 | Kaiser . | |
| 2,604,162 | 7/1952 | Hickling et al. . | |
| 2,625,221 | 1/1953 | McKee et al. | 160/209 |
| 2,966,212 | 12/1960 | Fimbel, Jr. . | |
| 3,021,896 | 2/1962 | Buono et al. . | |
| 4,119,133 | 10/1978 | Wolf . | |
| 4,379,478 | 4/1983 | Lichy . | |
| 4,878,529 | 11/1989 | Hormann . | |
| 5,240,216 | 8/1993 | Lin et al. | 160/201 X |
| 5,404,927 | 4/1995 | Bailey | 160/201 |
| 5,425,409 | 6/1995 | Guia . | |

FOREIGN PATENT DOCUMENTS

| | | |
|---|---|---|
| 657377 | 2/1963 | Canada . |
| 3602520 A1 | 7/1987 | Germany . |
| WO 96/36784 | 11/1996 | WIPO . |

*Primary Examiner*—David M. Purol
*Attorney, Agent, or Firm*—Wood, Herron & Evans L.L.P.

[57] ABSTRACT

A universal overhead door system includes a pair of horizontal track members, a pair of vertical track members and a pair of track radius members interconnecting the horizontal and vertical track members. A pair of short radius members extend from the track radius members to guide uppermost rollers of an overhead sectional door. The short radius members terminate close to the top of the door opening and thereby eliminate the need to guide the uppermost rollers below the level at which the curved portion of the track radius members begin. The ability to install the short radius members when needed for smaller door opening sizes and low head room environments provides a universal track system for most overhead door installations.

37 Claims, 10 Drawing Sheets

38
38
34
36
26
28
46
82b
46
70b
68
10
52
82a
80
30
86
70a
78
76
44
80
84
40
32
5
76
44
44
78
76
80
76
42
68
52
46
70b
58
74
22
46
72
48
134
5
64
136
174
34
54
152
170b
50
38
36
48
122
64
56
154
170b
156
154
150
156
162b

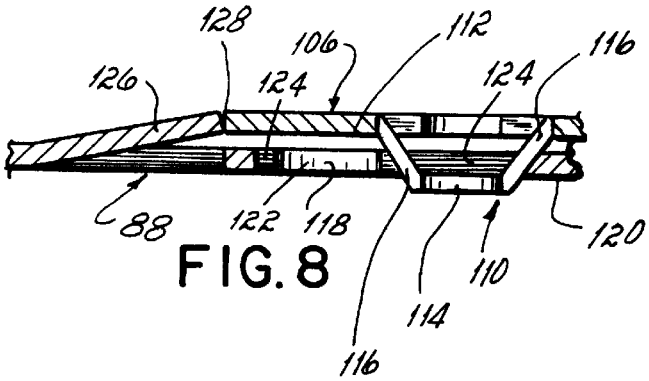
FIG. 8
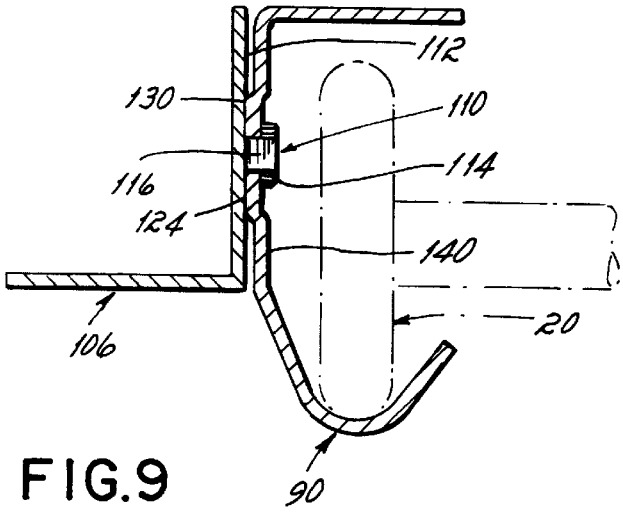
FIG. 9
FIG. 10A
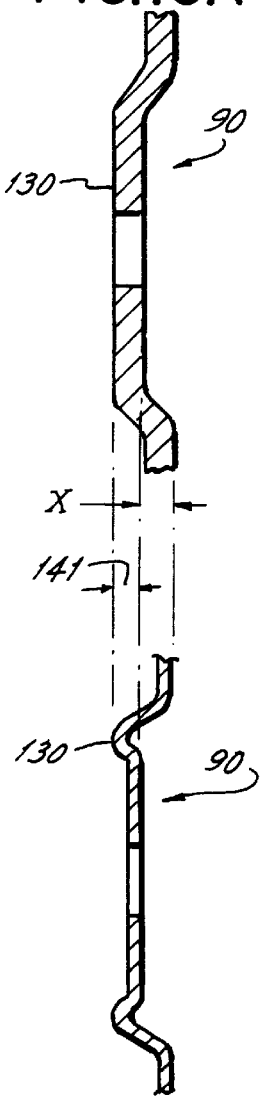
FIG. 10B

UNIVERSAL OVERHEAD DOOR SYSTEM

FIELD OF THE INVENTION

The present invention relates generally to overhead door systems and, more particularly, to interconnection of various components of an overhead door and track.

BACKGROUND OF THE INVENTION

Overhead garage door systems are widely used in both residential and commercial applications, and are designed to be operated either manually or automatically through a reversible motor. Overhead garage doors include a series of interconnected door panels that are connected along their longitudinal edges by one or more hinges to provide pivotal movement of the door panels between vertical and horizontal positions as is known in the art. The door panels include a series of roller brackets mounted on opposite sides of the door panels for supporting a series of rollers. The rollers travel in a pair of continuous tracks mounted on opposite sides of a door frame for guiding movement of the door panels between the vertical and horizontal positions.

Overhead garage door panels may include two or more spaced door stiles mounted vertically on each door panel to support various hardware components of the garage door system and to add additional strength and rigidity to the panels. These hardware components may include, for example, hinges for providing pivotal movement at the joint between adjacent door panels, and roller brackets for supporting the rollers that travel within the opposite pair of door tracks. Typically, hinges and roller brackets are attached to the door stiles through fasteners, such as rivets, screws and bolts for example, to provide an interconnection of components that can withstand the load and vibrational forces to which the door panels are generally subjected.

Additionally, the door tracks in which the garage door travels are typically mounted to a door frame through bracket and fastener assemblies. Each door track includes a horizontal track that extends generally parallel to the garage ceiling and has an integral radius section for guiding movement of the garage door between the horizontal and vertical positions, Each door track further includes a vertical track that is mounted generally parallel to the door frame and that forms a linear extension of the radius section which extends from the horizontal track. Depending on the size of the garage door opening and the available overhead room, different horizontal track radiuses are used to accommodate for different installation requirements. That is, one installation may require a ten inch radius on the horizontal track while another installation may require a twelve or fifteen inch radius. Thus, different configurations of horizontal track, i.e., with an integral ten, twelve or fifteen inch radius, for example, must be properly selected for a particular installation. Moreover, the length of the vertical track components may need to be adjusted to accommodate for lowered positioning of the horizontal track and integral radius.

Due to the size and weight of the overhead garage door components, and the general complexity associated with their assembly, overhead garage door systems typically are shipped by the manufacturer to a dealer for assembly at a site by a professional installer. It will be appreciated that the amount of parts which needs to be boxed and shipped by the manufacturer, as well as the length of time required for assembly of the overhead garage door system at each site, is affected by the number of mechanical fasteners included in the overhead garage door system. Moreover, the dealer or installer must carry a greater inventory of parts as the number of unique track components and fasteners in the overhead garage door system is increased.

Additionally, for garage door installations in low head room environments, various additional track components have typically been required. For example, one approach has been to provide dual parallel tracks, one above the other, with the upper track carrying the uppermost rollers of the overhead garage door. The upper track terminates close to the top of the garage door opening and thereby eliminates the need to guide the uppermost rollers below the level at which the curved portion of the track radius begins. Examples of this type of low head room track structure include U.S. Pat. Nos. 4,878,529, 4,119,133, 2,966,212, 2,436,006, and WO 96/36784.

Another approach to low head room installations has been to provide dual parallel tracks, arranged side-by-side, with one of the tracks carrying the uppermost rollers of the overhead garage door and the other track guiding the remaining rollers. Examples of this type of track system arrangement include U.S. Pat. Nos. 4,379,478, 2,064,470, and 2,045,060.

In yet another approach, as disclosed in Canadian Patent No. 657,377 and U.S. Pat. No. 1,990,870, for example, the requirement for parallel upper/lower or side-by-side tracks has been eliminated through the use of dual radius tracks mounted integrally on a corner bracket. The corner bracket includes a primary track radius that joins the horizontal and vertical track components, and an integral, auxiliary track radius that terminates near the top of the garage door opening. The auxiliary track radius guides uppermost rollers of the overhead garage door while the primary track radius guides movement of the remaining rollers between the vertical and horizontal tracks.

With this known approach, however, the primary and auxiliary track radiuses are not separable from the corner bracket, so the primary track radius cannot be used without the auxiliary track radius in normal head room installations. Moreover, in this known approach, use of the dual radius corner bracket requires the rollers extending from the side edges of the overhead garage door to be placed in a special staggered arrangement, or auxiliary rollers to be mounted to the side edges of the garage door.

Accordingly, there is a need in the overhead garage door industry for a connection system that provides rapid interconnection of garage door components in the field with a reduced number of mechanical fasteners to accomplish the interconnection. There is also a need for a connection system that is relatively easy to manufacture without requiring formation of complicated mechanical fastening structures on the individual garage door components. Moreover, there is a need for an overhead door system that is modular and easily configurable to accommodate for different door opening sizes and low head room environments.

SUMMARY OF THE INVENTION

To these ends, the connection system of the present invention provides for interconnection of components of an overhead garage door system, and provides a reliable interconnection of garage door components which may be subjected to loads and vibration during use of the overhead garage door system. The connection system of the present invention provides interconnection of two or more components without the need to manufacture complicated fastening structures on the various garage door components. Moreover, the overhead door system of the present invention is modular and readily accommodates for different door size openings and low head room environments.

In one aspect of the present invention, the connection system of the present invention includes a first component having a pair of spaced apart hook members, an intermediate guide member and a detent extending from a planar body of the first component. The connection system further includes a second component having a pair of spaced apart apertures which are shaped and aligned to receive the hook members, and an intermediate aperture which is shaped and aligned to receive the guide member upon registration of the first and second components in face-abutting relationship. As the first and second components are translated relative to each other, the detent of the first component engages the intermediate aperture of the second component to thereby establish a connection between the first and second components.

The hook members and guide member of the first component include retaining elements which are offset from and substantially parallel to the planar body of the first component. In this way, as the first and second components are translated relative to each other, the offset retaining elements of the hook members and guide member capture and engage a portion of the second component between the respective retaining elements and the planar body of the first component.

In another aspect of the present invention in the assembly of an overhead garage door system, a roller bracket is provided that includes the pair of spaced apart hook members, intermediate guide member and detent member. A door stile is further provided that includes the pair of spaced apart apertures shaped and aligned to receive the hook members, and the intermediate aperture shaped and aligned to receive the guide member upon registration of the roller bracket and door stile in face-abutting relationship. As the roller bracket and door stile are translated relative to each other, the detent of the roller bracket engages the intermediate aperture of the door stile to thereby establish a connection between the roller bracket and the door stile.

In yet another aspect of the present invention in the assembly of an overhead garage door system, the door stile includes a pair of guide members and an intermediate detent member extending from a planar web of the door stile. A door panel is provided that includes a pair of spaced apart apertures which are shaped and aligned to receive the guide members of the door stile upon registration of the door stile and door panel in face-abutting relationship. As the door stile is translated relative to the door panel, the detent of the door stile engages one of the spaced apart apertures in the door panel to thereby establish a connection between the door stile and the door panel.

In the assembly of an overhead garage door system in accordance with the principles of the present invention, a pair of door tracks are formed from respective pairs of horizontal tracks, vertical tracks and track radiuses that are assembled at the installation site. A pair of spaced horizontal rails are supported by a door frame and include a series of guide members that extend from a vertical surface of each horizontal rail. The horizontal tracks and track radiuses each include a series of apertures that are shaped and aligned to receive the guide members of the horizontal rails upon registration of the components in face-abutting relationship. As the components are translated relative to each other, the guide members of the horizontal rails engage the horizontal tracks and the track radiuses to establish a connection therebetween. The horizontal tracks, vertical tracks and track radiuses guide movement of the overhead garage door between the horizontal and vertical positions.

To accommodate for different door opening sizes and low head room environments, a pair of short radius track members are provided to be interconnected with the door tracks of the overhead garage door system. In particular, the overhead garage door system includes respective pairs of horizontal tracks, vertical tracks and track radiuses that are assembled to form a pair of door tracks mounted on opposite sides of the overhead garage door. The pair of track radiuses include openings which permit uppermost rollers of the overhead garage door to travel outside of the door tracks during movement of the garage door to the vertical or closed position. The short radius track members are mounted to extend from the openings in the track radiuses for guiding movement of the uppermost rollers into and out of the track radiuses during movement of the overhead garage door between the horizontal and vertical positions. The short radius track members terminate close to the top of the garage door opening and thereby eliminate the need to guide the uppermost rollers below the level at which the curved portion of the track radiuses begin. A pair of follower members are connected to the respective pair of uppermost rollers for carrying the uppermost rollers through the openings in the track radiuses during movement of the overhead garage door between the vertical and horizontal positions.

The above features and advantages of the present invention will be better understood with reference to the accompanying figures and detailed description.

BRIEF DESCRIPTION OF THE DRAWINGS

Reference will now be made to the accompanying figures from which the novel features and advantages of the present invention will be apparent:

FIG. 8 is a cross-sectional view taken along line 8—8 in FIG. 7 showing interconnection of a horizontal track with a horizontal rail;

FIG. 9 is a cross-sectional view taken along line 9—9 in FIG. 7 showing interconnection of a horizontal track with a horizontal rail;

FIG. 10A is an enlarged partial cross-sectional view of a track component in accordance with one aspect of the present invention;

FIG. 10B is a view similar to FIG. 10A showing a modified track component;

DETAILED DESCRIPTION OF THE INVENTION

Figure 1:
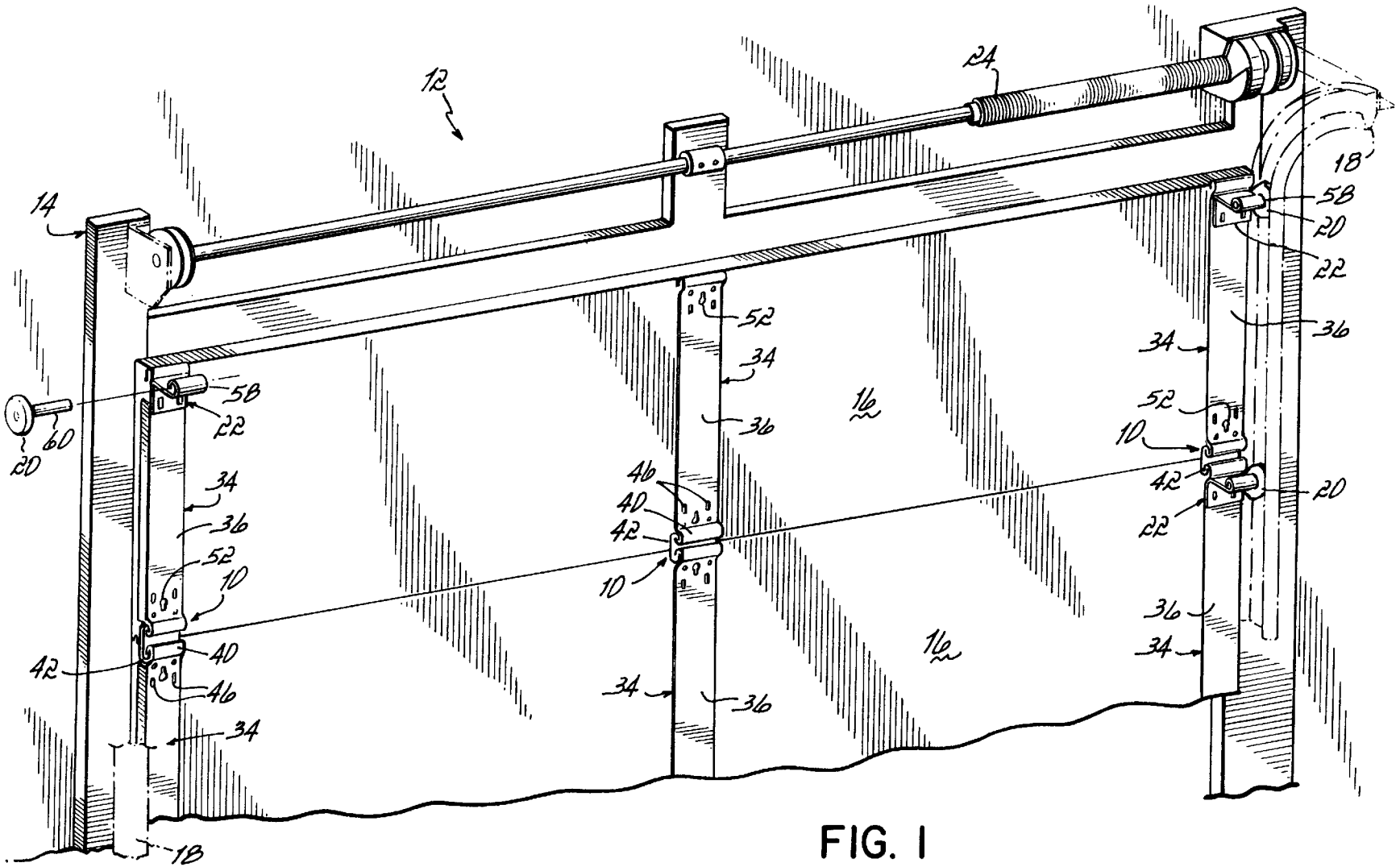
FIG. 1 is a perspective view, partially broken away, of a connection system in accordance with the principles of the present invention for interconnecting components of an overhead garage door system.

With reference to the figures, and to FIG. 1 in particular, a connection system 10 in accordance with the principles of the present invention is shown for interconnecting components of an overhead garage door system 12. The overhead garage door system 12 includes a conventional door frame 14 that defines an opening into a garage, and a series of interconnected door panels 16 that articulate in a known manner between a vertical position as shown in FIG. 1 and an overhead, horizontal position not shown. The movement of the garage door panels 16 between the vertical and horizontal positions is defined by a pair of door tracks 18 (shown in phantom) that are located on either side of the door frame 14. The door tracks 18 cooperate with a series of rollers 20 supported along opposite sides of the door panels by roller brackets 22 as will be described in more detail below. A torsion spring 24 is mounted along a top edge of the door frame 14 to counterbalance the weight of the door panels 16 and thus ease movement of the interconnected door panels between the vertical and horizontal positions as is well known in the art.

Figure 2:
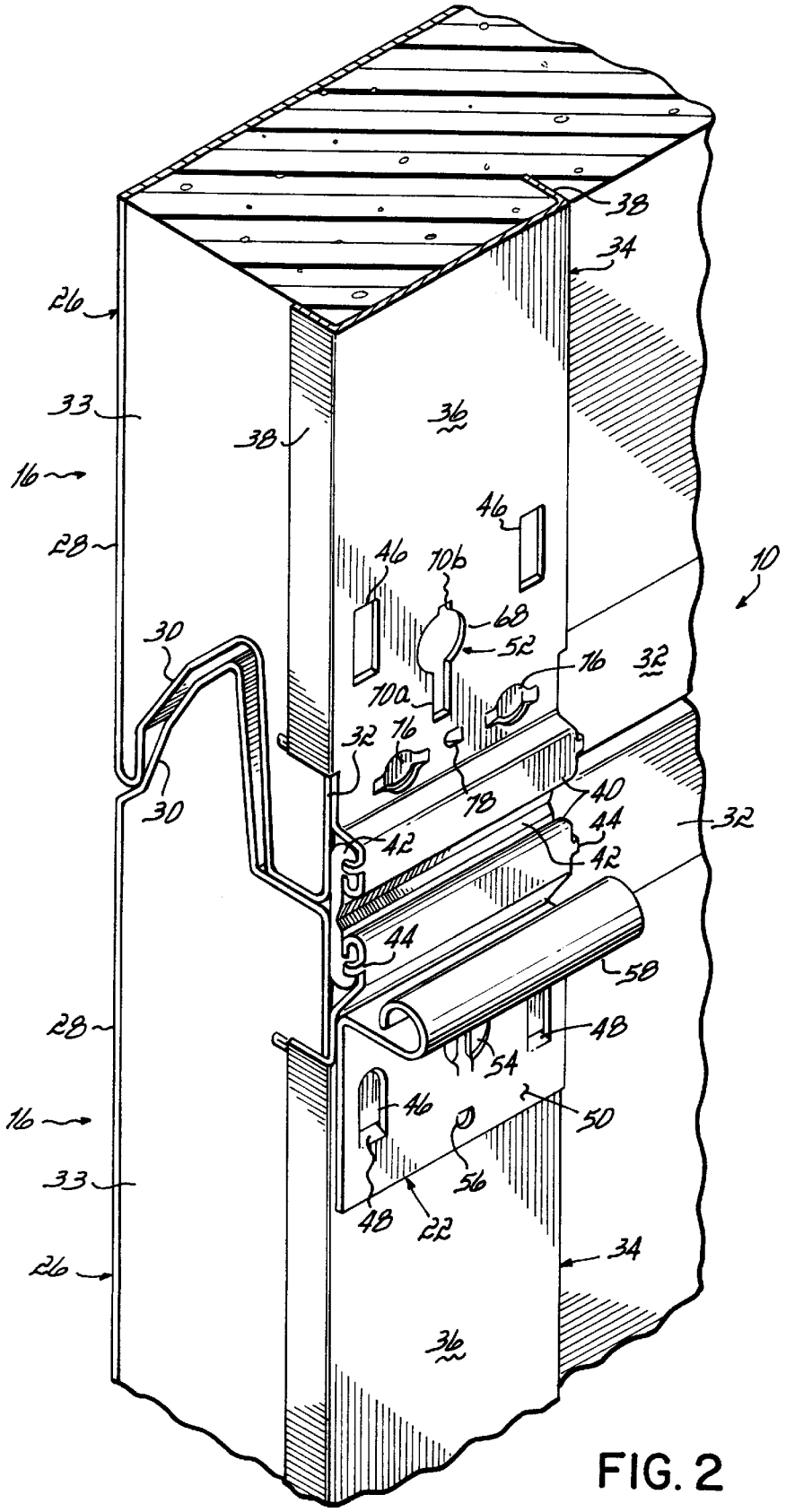
FIG. 2 is a partial perspective view of the connection system for interconnecting roller brackets and door stiles with an overhead garage door panel.
Figures 3, 3A:
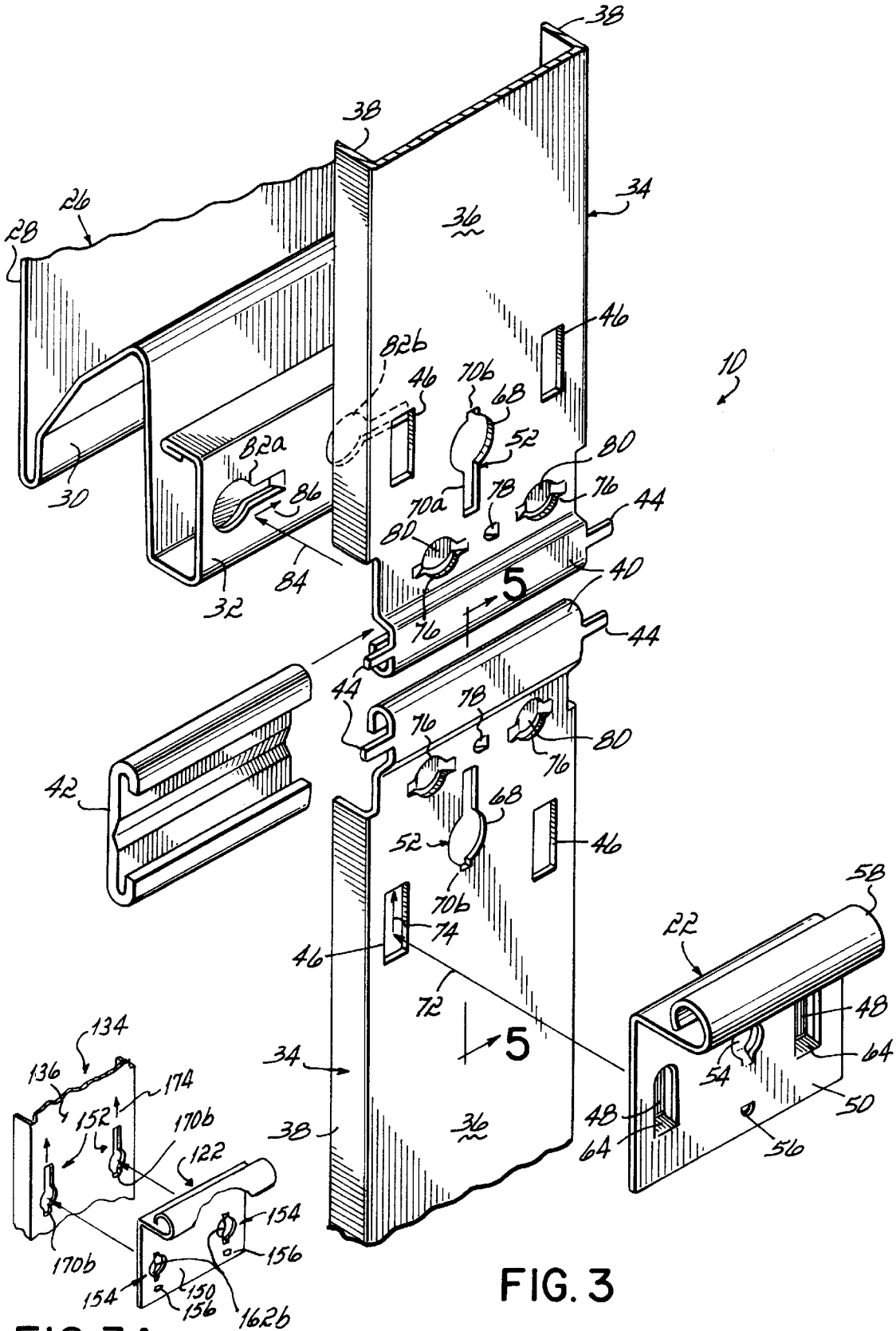
FIG. 3 is an exploded perspective view showing components of the connection system shown in FIG. 2.
FIG. 3A is a partial perspective view, similar to FIG. 3, showing an alternative embodiment of the present invention.
Figure 4:
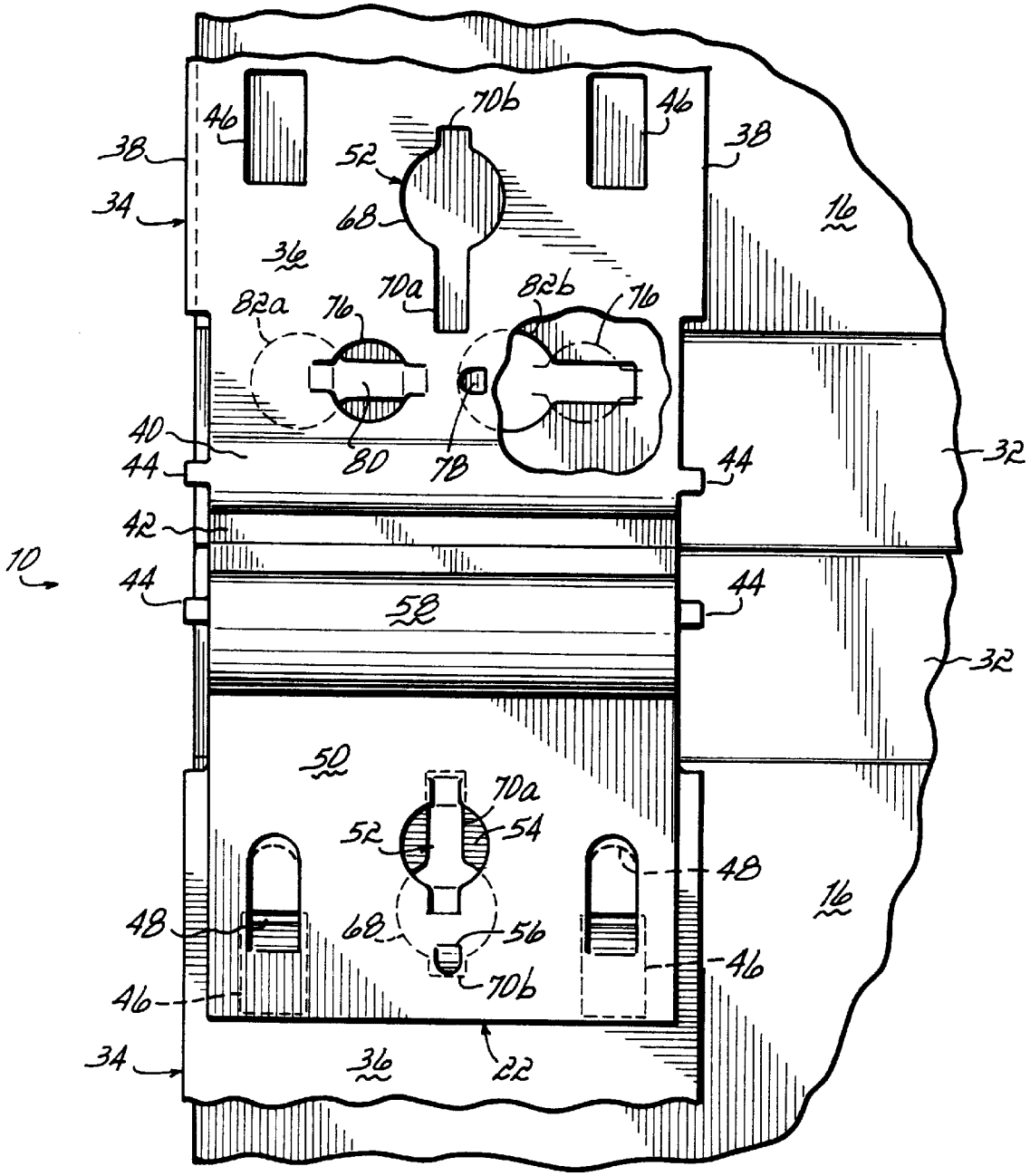
FIG. 4 is a front view showing the connection system of FIG. 2.

As shown most clearly in FIGS. 2–3, each of the door panels 16 preferably comprises a formed metallic door skin 26 that includes an outer face 28, a pinch-resistant joint 30, and an inner rib 32 that extend along the longitudinal length of the door panel. The outer face 28, joint 30 and inner rib 32 of the door panel 16 define a cavity that may be filled with a suitable foam composition 33 as is described in detail by way of example in U.S. Pat. No. 5,435,108, assigned to the assignee of the present invention, and which is incorporated herein by reference in its entirety. While a pinch-resistant, foam-filled pan door panel 16 is shown and described, the present invention is readily adaptable to other configurations of door panels without departing from the spirit and scope of the present invention.

With further reference to FIG. 1, each of the door panels 16 includes a series of vertically aligned and spaced door stiles 34 that extend between longitudinal edges of each door panel. As will be described in more detail below, the door stiles 34 are pivotally interconnected between adjacent door panels 16 to provide pivotal movement of the door panels between the vertical and horizontal positions. The door stiles 34 may be formed of metal and include a generally planar web 36 and a pair of spaced transverse legs 38 which extend partially along opposite sides of the stiles. At each end of the door stiles 34, a hinge mount 40 is provided to slidably receive and support a portion of a living hinge 42 within the hinge mount. In this way, as shown most clearly in FIG. 2, the living hinges 42 are located at the joints between adjacent door panels 16 and are supported by pairs of hinge mounts 40 at adjacent ends of the door stiles 34. By way of example, details of the construction and operation of living hinges may be found in U.S. Pat. Nos. 4,995,441, 5,054,536 and 5,129,441, all assigned to the assignee of the present invention, which are incorporated herein by reference in their entirety. As shown in FIGS. 2 and 3, tabs 44 are formed on opposite sides of the hinge mounts 40, and are adapted to fold over and capture the living hinges 42 within the hinge mounts 40.

Now referring to FIGS. 2–6, roller brackets 22 are shown interconnected to the door stiles 34 through the connection system 10 of the present invention for supporting the rollers 20. In particular, each end of the door stiles 34 includes a pair of spaced apart apertures 46 formed in the planar web 36 of the stiles that are shaped and aligned to receive a pair of hooks 48 extending from a substantially planar body 50 of the roller bracket 22. Each end of the door stiles 34 further includes an aperture 52 formed in the planar web 36 of the stiles that is shaped and aligned to receive a guide member 54 extending from the planar body 50 of the roller bracket 22. The roller bracket 22 further includes a detent 56 that is formed from material punched from the roller bracket and that extends in the same direction as the hooks 48 and the guide member 54 for purposes to be described in more detail below. The roller brackets 22 each include a tubular end 58 that is adapted to support a shaft 60 of the rollers 22 in a conventional manner.

Figure 6:
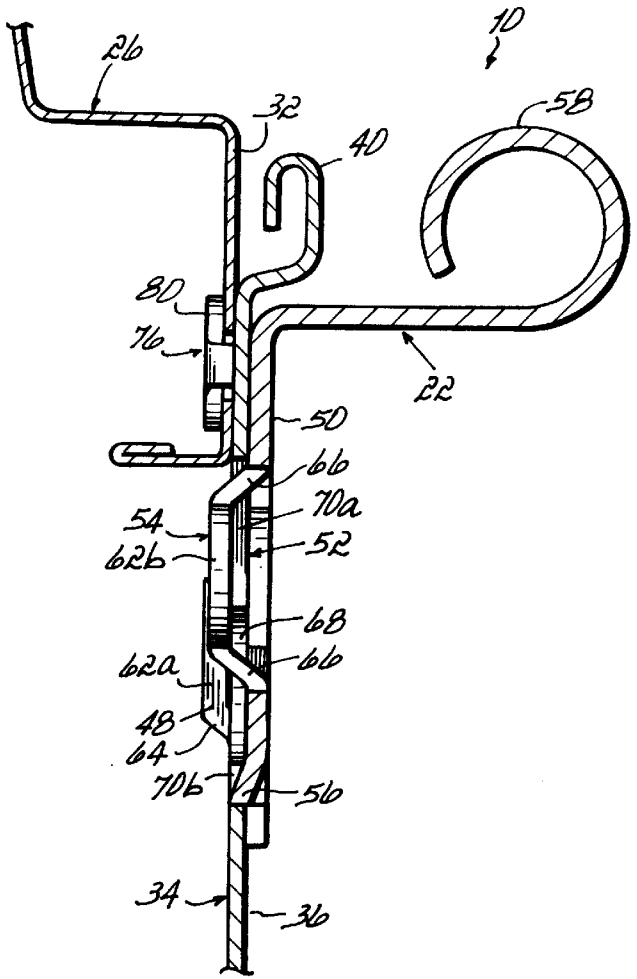
FIG. 6 is a view similar to FIG. 5 showing components of the connection system after assembly.
Figure 5:
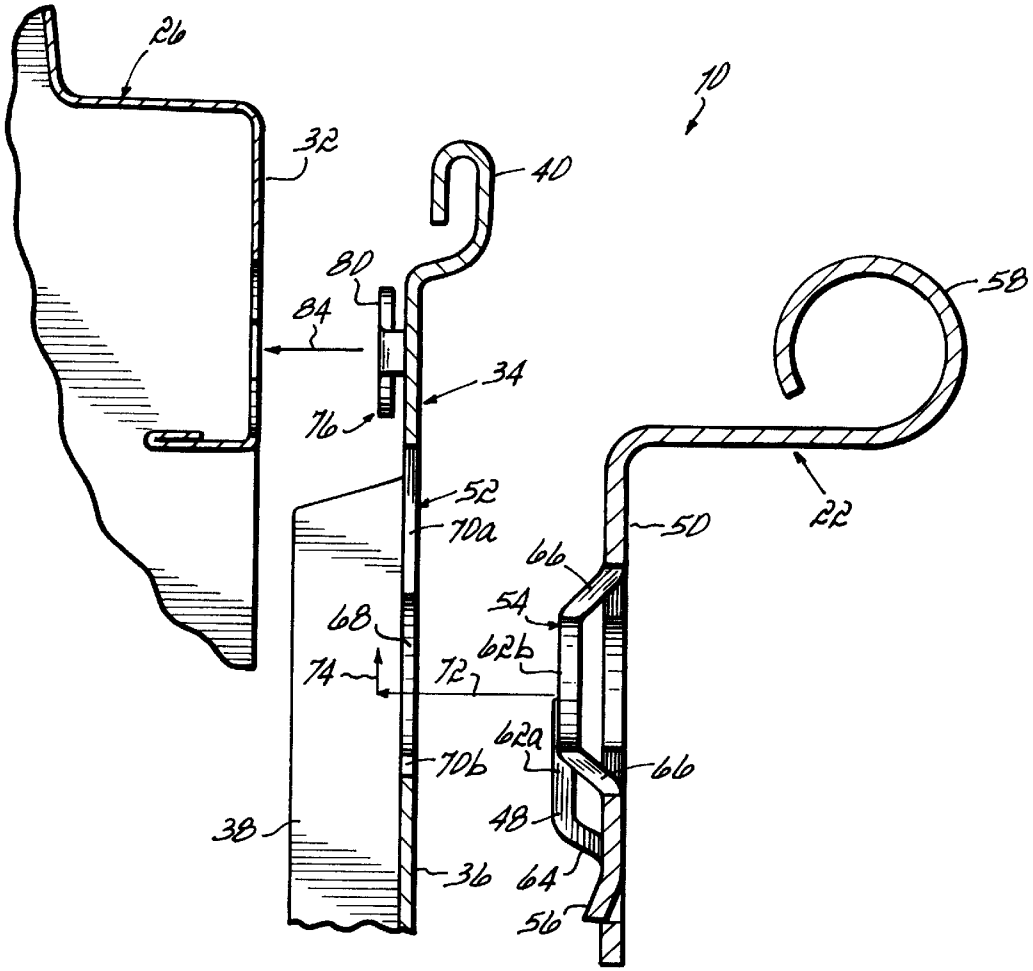
FIG. 5 is an exploded cross-sectional view, taken along line 5—5 of FIG. 3, showing components of the connection system before assembly.

As shown most clearly in FIGS. 5 and 6, the hooks 48 and the guide member 54 include respective retaining elements 62*a* and 62*b* that are offset from and substantially parallel to the planar body 50 of the roller bracket. Offset retaining elements 62*a* of hooks 48 are joined to the roller brackets 22 through integral legs 64. Offset retaining elements 62*b* of guide members 54 may be circular in configuration, and are joined to the roller brackets 22 through pairs of diametrically opposite webs 66. Retaining elements 62*a* and 62*b* of hooks 48 and guide members 54, respectively, comprise material punched from the planar body 50 of the roller brackets 22.

The aperture 52 of door stiles 34 is located between the spaced apart apertures 46, and may be at least partially aligned with the spaced apart apertures 46 between opposite longitudinal edges of the door stile 34. The guide member 54 of the roller bracket 22 may be preferably at least partially aligned with the pair of hooks 48 between the opposite longitudinal edges of the door stile 34. In one embodiment as shown, the guide member 54 and detent 56 are aligned with a longitudinal axis of the roller bracket 22. Aperture 52 includes an opening 68 (see FIG. 3) sized slightly larger than retaining element 62*b* of guide member 54, and a pair of diametrically opposite slots 70*a* and 70*b* (see FIG. 3) that extend from the opening 68 and are sized slightly smaller than retaining element 62*b* but slightly larger than webs 66. The slots 70*a* and 70*b* may be aligned with the longitudinal axis of the roller bracket 22, and slot 70*b* may be shorter in length than slot 70*a* for purposes to be described in detail below.

With further reference to FIGS. 3–6, the roller bracket 22 is connected to the door stile 34 by first aligning the hooks 48 with the spaced apart apertures 46, and also by aligning the guide member 54 with the opening 60, as represented by arrow 72 in FIGS. 3 and 5. With the roller bracket 22 and door stile 34 aligned in face-abutting relationship (see FIG. 6), the components are then translated relative to each other in the direction of arrow 74 shown in FIGS. 3 and 5 until the detent 56 engages the slot 70*b* of aperture 52 as shown in FIG. 6. In this way, as shown most clearly in FIGS. 2 and 4, the hooks 48 and guide member 54 of each roller bracket 22 engage and capture part of the door stile 34 between the respective offset retaining elements 62*a* and 62*b* and the planar body 50 of the roller bracket. The engagement of the detent 56 with the slot 70*b* prevents unintentional disengagement of the roller bracket 22 from the door stile 34. Separation of the roller bracket 22 from the door stile 34 is achieved by disengaging the detent 56 from the slot 70*b* and then translating the components in a direction opposite to that represented by arrow 74 in FIGS. 3 and 5.

In an alternative embodiment shown in FIG. 3A, a modified roller bracket 122 includes a pair of spaced guide members 154 and a pair of detents 156 which extend in the same direction from a substantially planar body 150 of the roller bracket 122. The guide members 154 and detents 156 each may have the same respective structure as the guide member 54 and detent 56 as described in detail above. A modified door stile 134 includes a pair of apertures 152 formed in a planar web 136 of the stile which are shaped and aligned to receive the guide members 154. The apertures 152 may have the same structure as the apertures 52 described in detail above. With the roller bracket 122 and door stile 134 aligned in face-abutting relationship, the components are translated relative to each other in the direction of arrow 174 until the detents 156 engage slots 170*b* of apertures 152. In this way, the guide members 154 of each roller bracket 122 engage and capture part of the door stile 134 between the respective offset retaining elements 162*b* and the planar body 150 of the roller bracket 122. The engagement of the detents 156 with the slots 170*b* prevents unintentional disengagement of the roller bracket 122 from the door stile 134. Separation of the roller bracket 122 from the door stile 134 is achieved by disengaging the detents 156 from the slots 170*b* and then translating the components in a direction opposite to that represented by arrow 174.

In another aspect of the present invention, as shown most clearly in FIGS. 2–6, each of the door stiles 34 has a pair of guide members 76 and an intermediate detent 78 that extend from the planar web 36 of the door stile. Each of the guide members 76 includes a retaining element 80, that may be circular in shape, and that is offset from and substantially parallel to the planar web 36 of the door stile 24. The inner rib 32 of the door panels 16 includes a pair of spaced apart apertures 82*a* and 82*b* which are shaped and aligned to receive the guide members 76 upon registration of the door stiles 34 and door panels 16 in face-abutting relationship as represented by arrow 84 in FIGS. 3 and 5. As the door stile 34 is translated relative to the door panel 16 in a direction represented by arrow 86 in FIG. 3, the detent 78 engages aperture 82*b* in the inner rib 32 of door panel 16. In this way, as shown most clearly in FIGS. 2 and 4, the guide members 76 of each door stile 34 engage and capture part of the inner rib 32 of the door panel 16 between the offset retaining element 80 and the planar web 36 of the door stile 34 (see FIG. 4). The engagement of the detent 78 with the aperture 82*b* prevents unintentional disengagement of the door stile 34 from the door panel 16. Separation of the door stile 34 from the door panel 16 is likewise achieved by disengaging the detent 78 from the aperture 82*b* and then translating the components in a direction opposite to that represented by arrow 86 in FIG. 3.

Figure 7:
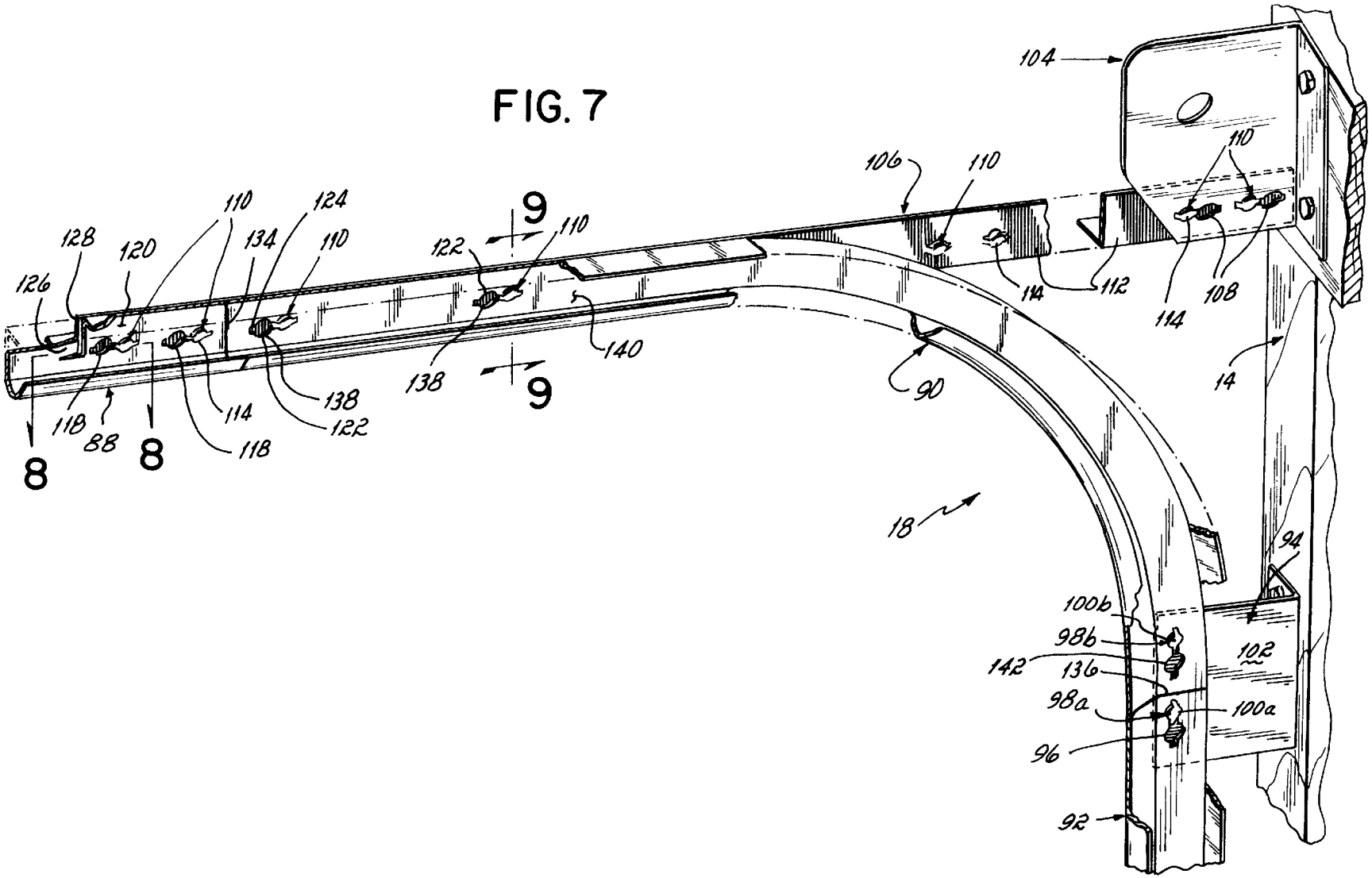
FIG. 7 is a partial perspective view showing the connection system in accordance with the principles of the present invention for interconnecting components of an overhead garage door track.

Now referring to FIGS. 7–10B, interconnection of the door tracks 18 in accordance with the principles of the present invention is shown in greater detail. While only one door track 18 is shown in FIG. 7, it will be appreciated that the other door track located on the opposite side of door panels 16 is preferably identical in construction and operation, and the same description applies equally as well to both. In accordance with the principles of the present invention, each door track 18 may include a horizontal track 88, a track radius 90 and a vertical track 92 that are supported by the door frame 14 to guide vertical and horizontal movement of the overhead garage door.

As shown in FIG. 7, the vertical track 92 is mounted generally parallel to the door frame 14 through a series of jamb brackets 94 (one shown) that are mounted to the door frame through suitable fasteners. Each vertical track 92 includes an aperture 96 on an upper end thereof which is shaped and sized to receive a guide member 98*a* which extends from the jamb bracket 94. The guide member 98*a* includes a retaining element 100*a* which is offset from and substantially parallel to a vertical surface 102 of the jamb bracket 94. As the jamb bracket 94 and vertical track 92 are translated relative to each other, the retaining element 100*a* engages and captures part of the vertical track between the retaining element and the vertical surface of the jamb bracket. While not shown, it will be appreciated that a similar jamb bracket is connected at a lower end of the vertical track 92 to further mount the vertical track to the door frame 14.

A torsion tube end bearing plate 104 is mounted on opposite sides of the door frame 14 for supporting the torsion spring 24 (FIG. 1). Each bearing plate 104 supports an angled rail 106 which extends generally horizontally from the door frame 14. Each bearing plate 104 may include a pair of apertures 108 that are shaped and sized to receive a pair of guide members 110 extending from a vertical surface 112 of the horizontal rail 106. The guide members 110 may include retaining elements 114 that are offset from and substantially parallel to the vertical surface 112 of the horizontal rail 106. As shown most clearly in FIGS. 7 and 8, the offset retaining elements 114 of horizontal rail 106 may be circular in cross-section and are joined to the horizontal rail through pairs of diametrically opposite webs 116. As the horizontal rail 106 and bearing plate 104 are translated relative to each other, the retaining elements 114 engage and capture part of the bearing plate 104 between the retaining elements and the vertical surface of the horizontal rail 106. While not shown, it will be appreciated that in another embodiment, bearing plates 104 and horizontal rails 106 could be an integral, unitary piece.

The horizontal tracks 88 are mounted at a remote end of the horizontal rail 106 and extend rearwardly from the door frame 14. While not shown, it will be understood by those skilled in the art that the rearward most ends of the horizontal tracks 88 are supported through suitable means by a supporting structure of the garage ceiling. Depending on the size of the garage door, it will be appreciated that the horizontal rails 106 may be 32", 94" or 106" in length, while the horizontal tracks 88 may be between 72" and 84" in length, for example.

Referring to FIGS. 7–8, the horizontal tracks 88 may include a series of apertures 118 formed in a vertical surface 120 of the horizontal tracks that are shaped and aligned to receive the guide members 110 extending from the horizontal rails 106. Each of the apertures 118 may include an opening 122 (FIG. 8) sized slightly larger than the retaining element 114 of guide member 110, and a pair of diametrically opposite slots 124 (FIG. 8) that extend from the opening 122 and are sized slightly smaller than the retaining element 114 but slightly larger than webs 116.

Further referring to FIGS. 7–8, with the horizontal rails 106 and horizontal tracks 88 aligned in face-abutting relationship, the components are then translated relative to each other until a deflectable tab 126 on each horizontal track 88 engages a respective end 128 of the horizontal rails 106. In this way, the guide members 110 of each horizontal rail 106 engage and capture part of the horizontal track 88 between the respective offset retaining elements 114 and the vertical surface 112 of the horizontal rail 106. The engagement of the deflectable tab 126 with the end 128 of the horizontal rail 106 prevents unintentional disengagement of the horizontal rail from the bearing plate 104 mounted to the door frame 14. Separation of the horizontal rail 106 from the horizontal track 88 is achieved by disengaging the deflectable tab 126 from the end 128 of horizontal rail 106 and then translating the components in an opposite direction.

With further reference to FIG. 7, the track radius 90 is mounted intermediate the horizontal track 88 and the vertical track 92. More particularly, each track radius 90 is mounted to the horizontal rail 106 and the jamb bracket 94 such that the track radius substantially abuts an end 134 of the horizontal track 88 and an end 136 of the vertical track 92. Each track radius 90 has a defined radius that may vary between 10", 12" and 15", although other radiuses are also contemplated. While not shown, it will be appreciated that in another embodiment, track radius 90 could be an integral extension of the horizontal track 88.

At one end near the horizontal rails 106, each track radius 90 includes a series of apertures 138 formed in a vertical surface 140 of the track radius which are shaped and aligned to receive the guide members 110 which extend from the horizontal rails 106. As the horizontal rails 106 and track radiuses 90 are translated relative to each other, the retaining elements 114 of guide members 110 engage and capture part of the track radius between the retaining element 114 and the vertical surface 112 of the horizontal rail.

Now referring to FIGS. 10A and 10B, a preferred cross-sectional profile of the track radius 90 is shown for accommodating changes in material thickness of the track radiuses while maintaining proper engagement of the guide members 110 of the horizontal rails 106 with the apertures 138 of the track radiuses 90. In order to prevent having to change the depth of the guide members 110 as the material thickness in the track radiuses 90 changes, the vertical surface 140 of the track radiuses 90 is offset relative to a rearward contact surface 130 of the track radiuses to maintain a substantially constant offset 141 (FIGS. 10A and 10B) for any material thickness of the track radiuses 90. Thus, while the thickness of material in the track radiuses 90 of FIG. 10A may be 0.083", for example, the offset 141 is substantially the same for the track radius 90 in FIG. 10B which may have a material thickness of 0.040", for example, to substantially match the depth of the guide member 110 of the horizontal rail 106. The offset 141 is preferably roll-formed in the vertical surface 140 of the track radius 90, although a continuous or intermittent stamping of the offset is also contemplated. It will be appreciated that the constant offset 141 in the track radiuses 90 thereby allows a standard horizontal rail 106 to be used with all track radiuses of varying material thickness. Moreover, as shown most clearly in FIGS. 9 and 10A–10B, an offset "X" formed in the track radiuses 90 prevents the guide members 110 of the horizontal rails 106 from interfering with the rollers 20 attached to the door panels 16. It will be understood that the horizontal tracks 88 and vertical tracks 92 preferably have the same cross-sectional profile as the track radiuses 90 to achieve the same benefits as described in detail above.

Each track radius 90 further preferably includes an aperture 142 at the other end near the vertical track 92 which is shaped and sized to receive a guide member 98*b* which extends from the jamb bracket 94. Each aperture 138 and 142 in track radiuses 90 preferably has the same configuration as apertures 118 in the horizontal tracks 88. The guide member 98*b* preferably includes a retaining element 100*b* which is offset from and substantially parallel to the vertical surface 102 of the jamb bracket 94. As the jamb bracket 94 and track radius 90 are translated relative to each other, the retaining element 100*b* engages and captures part of the track radius between the retaining element 100*b* and the vertical surface of the jamb bracket.

In accordance with the present invention, each track radius 90 is preferably interchangeable with a different track radius having a different defined radius. Thus, the need for a dealer or installer to inventory separate horizontal track members having different track radiuses is completely eliminated. Rather, the horizontal rails 106, horizontal tracks 88 and vertical tracks 92 become standard overhead garage door components that may be then connected at the site with the proper 10", 12" or 15" track radius 90 as may be required. Moreover, the interconnection of the door tracks 18 in accordance with the present invention eliminates the need for additional fasteners to be installed in the field or for hardware to be riveted or bolted to track components at the factory before shipment.

Figure 11:
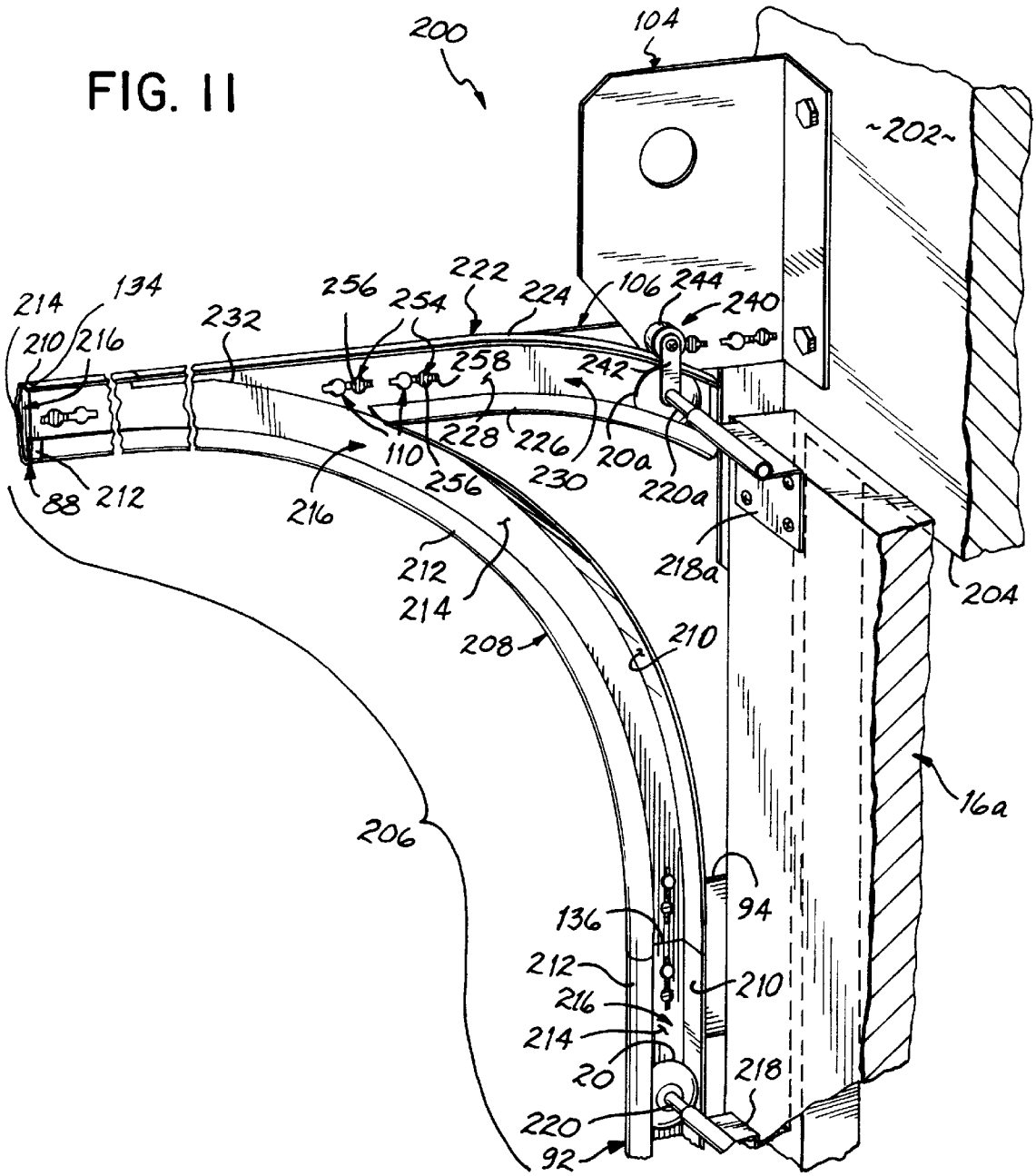
FIG. 11 is a perspective view of a universal overhead door system in accordance with the principles of the present invention.

Now referring to FIGS. 11, 11A, 12 and 13, a universal overhead door system 200 (FIG. 11) is shown in accordance with the principles of the present invention. The overhead door system 200 includes a conventional door frame 202 that defines an opening 204 into a garage, and a series of interconnected door panels 16 that articulate between vertical and horizontal positions. Door tracks 206 (one shown) are located on either side of the door panels 16 for guiding movement of the door panels 16 between the horizontal and vertical positions. While only one door track 206 is shown in FIG. 11, it will be appreciated that the other door track located on the opposite side of door panels 16 is identical in construction.

As shown most clearly in FIG. 11, the door tracks 206 preferably include horizontal tracks 88 (one shown) that are supported by horizontal rails 106, and vertical tracks 92 mounted to door frame 202 through jamb brackets 94 as discussed in detail above. Track radiuses 208 are preferably mounted at opposite ends to the horizontal rails 106 and jamb brackets 94 as discussed in detail above with reference to track radiuses 90. The track radiuses 208 are mounted intermediate the horizontal tracks 88 and vertical tracks 92 such that the track radiuses 208 substantially abut respective ends 134 of horizontal tracks 88 and ends 136 of vertical tracks 92. Preferably, each track radius 208 has a defined radius that varies and is interchangeable between 10", 122" and 15", although other radiuses are also contemplated. As will be described in more detail below, a track radius 208 having a radius of 15" is presently preferred for the universal overhead door system 200. While not shown, it is contemplated that in another embodiment, the track radiuses 208 could be formed as integral extensions of horizontal tracks 88 without departing from the spirit and scope of the present invention.

Each of the horizontal tracks 88, track radiuses 208 and vertical tracks 92 are preferably channel-shaped, as defined by an upper flange 210, a lower curved flange 212 and an integral web 214, to form a substantially continuous channel 216 on opposite sides of the door panels 16. Roller brackets 218 are mounted on opposite sides of the door panels 16 to preferably support a series of rollers 20 which travel in the channels 216 as will be described in more detail below. Rollers 20 are supported on axles 220 which extend from opposite sides of the door panels 20. It will be appreciated that while rollers 20, axles 220 and channels 216 are shown, other door panel guiding structures are contemplated without departing from the spirit and scope of the present invention. For example, in another embodiment not shown, it is contemplated that the channels 216 could be formed as channel-shaped slots which guide slidable block members that extend from opposite sides of the door panels 16. The slidable block members are received in the slots for guiding movement of the door panels 16 between the vertical and horizontal positions. Those skilled in the art will readily appreciate other door panel guiding structures to which the present invention is susceptible.

In accordance with the present invention, a pair of short radius members 222 (one shown) are mounted on opposite sides of door frame 202 that terminate close to the top of the door frame 202 as shown most clearly in FIG. 11. Preferably, the short radius members 222 are channel-shaped having an upper flange 224, a lower curved flange 226 and an integral web 228 that define channels 230 for guiding uppermost rollers 20*a* (FIGS. 11, 12 and 13) mounted to the uppermost door panel 16*a* through axles 220*a*. Preferably, short radius members 222 have a greater radius of curvature than the track radiuses 208.

Figure 12:
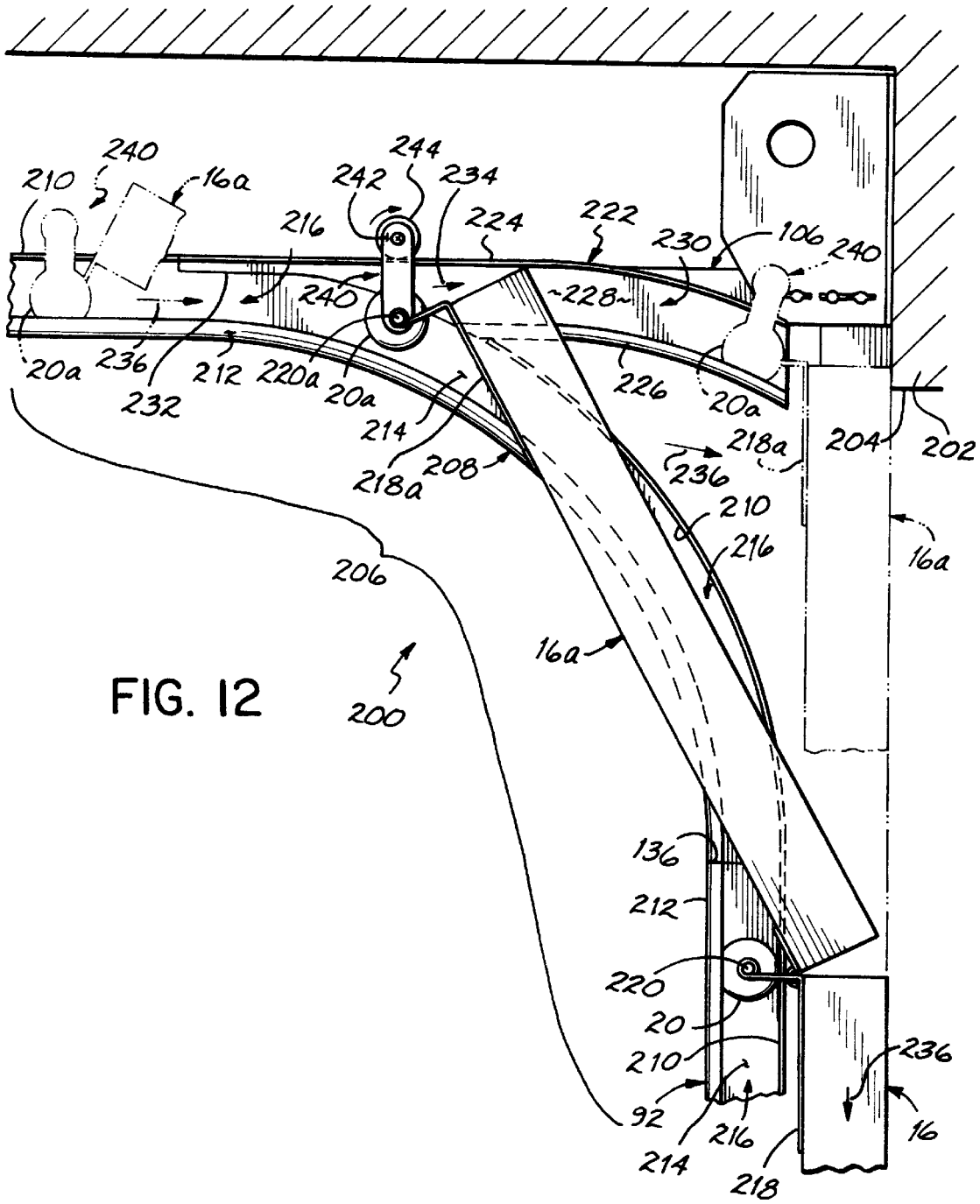
FIG. 12 is a side view showing operation of the universal overhead door system.

As shown most clearly in FIGS. 11 and 12, track radiuses 208 have an opening 232 that permits the uppermost rollers 20*a* to travel outside of the channels 216 (represented by arrow 234 in FIG. 12) as the door panels 16 move to the vertical or closed position as represented by arrows 236 in FIG. 12. Channels 230 of short radius members 222 are preferably mounted in removable registry with openings 232 in track radiuses 208 to guide uppermost rollers 16*a* during movement of the door panels 16 between the vertical and horizontal positions. In operation, as door panels 16 move to the vertical or closed position, the channels 230 of short radius members 222 receive and guide uppermost rollers 20*a* close to the top of the door frame 202 as shown most clearly in FIG. 11, and in phantom in FIG. 12. As the door panels 16 move to the horizontal or open position, the channels 230 of short radius members 222 guide uppermost rollers 20*a* through the openings 232 in track radiuses 208 to travel within channels 216 of door tracks 206.

Figure 11A:
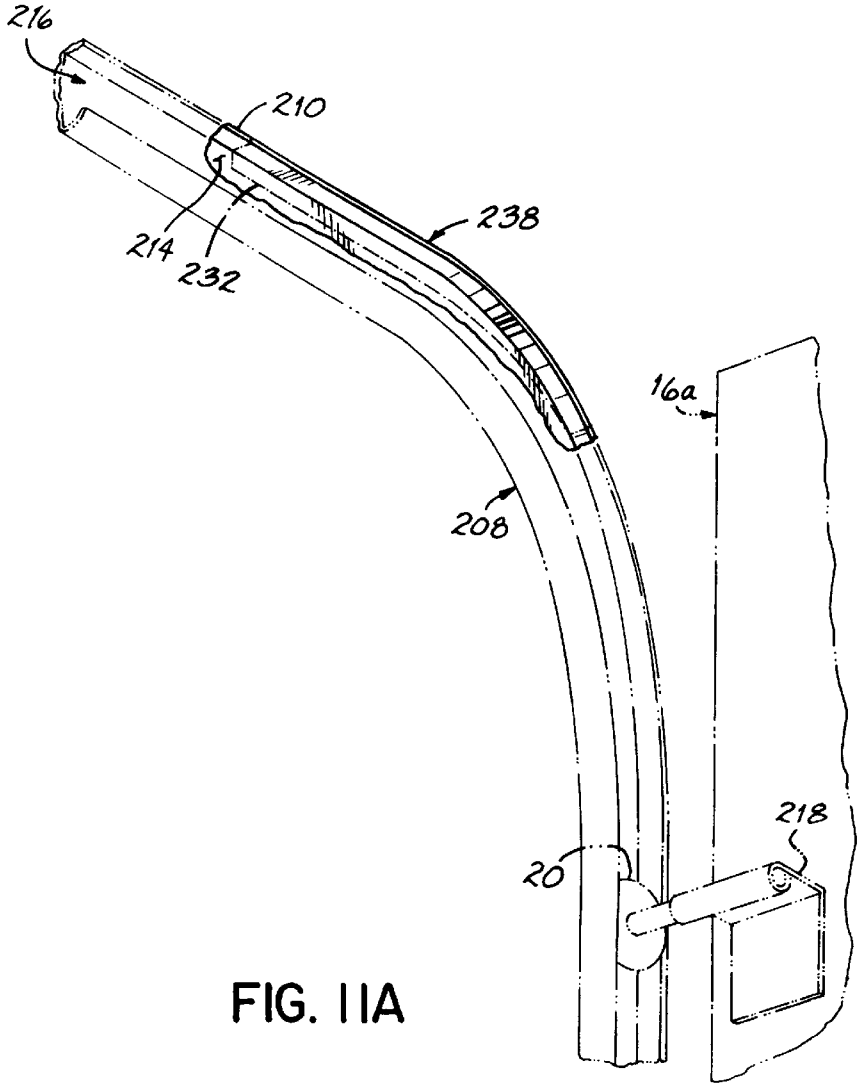
FIG. 11A is a bottom perspective view of a track radius of the universal overhead door system, showing a removable section formed as part of the track radius.

As shown most clearly in FIG. 11A, the openings 232 in track radiuses 208 are preferably formed by removing a section 238 that forms at least part of the upper flange 210 of the track radiuses 208. The removable section 238 may be formed in the upper flange 210 by perforating, scoring, fastening or otherwise altering the upper flange 210 in such a way that the section 238 may be easily removed from the track radius 208 when the short radius member 222 is used. Since the short radius members 222 terminate close to the top of the door frame 202, thereby eliminating the need to guide the uppermost rollers 20*a* below the level at which the curved portion of the track radiuses 208 begin, the length of the vertical tracks 92 may need to be shortened.

Figure 13:
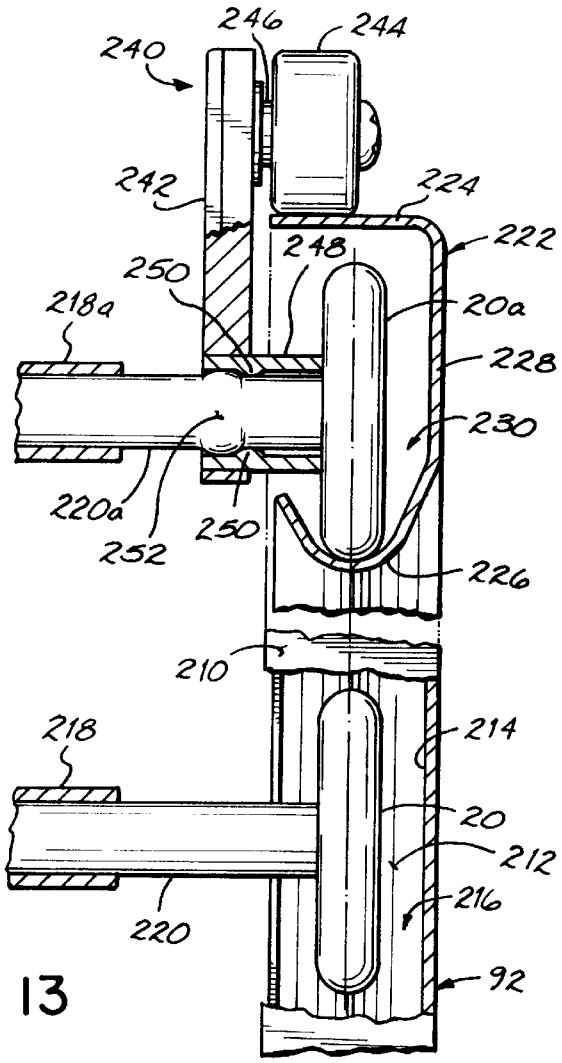
FIG. 13 is a fragmentary cross-sectional view of the roller arrangement of the universal overhead door system of FIGS. 11 and 12.

As shown most clearly in FIGS. 11, 12 and 13, the uppermost rollers 20*a* and axles 220*a* are preferably carried by follower members 240 that are connected to the axles 220*a* through linkage members 242. Follower members 240 preferably include rollers 244 that are supported by the linkage members 242 through axles 246 (FIG. 13). As shown most clearly in FIG. 13, each of the linkage members 242 includes a sleeve 248 at one end that includes a radially inwardly directed stop 250. Sleeves 248 may be integrally formed or otherwise secured to one end of the linkage members 242. Each of the axles 220*a* preferably includes a radially outwardly directed stop 252 which cooperates with the stop 250 in the linkage sleeve 248 to prevent movement of the follower members 240 inward toward the side edges of the door panel 16*a*. It will be appreciated that other formations of the stops 250 and 252 are possible without departing from the spirit and scope of the present invention. When the short radius members 222 are installed, the uppermost rollers 20 and axles 220 are simply removed from the uppermost roller brackets 218*a* and replaced with rollers 20*a* and axles 220*a*, with the follower members 240 connected to the axles 220*a* through linkage members 242. In this way, the overhead garage door system 200 is easily converted when the short radius members 222 are installed by simply changing the roller hardware, without requiring changes to or customization of the uppermost door panel 16*a*.

Still referring to FIGS. 11, 12 and 13, the rollers 244 of follower members 240 preferably travel along the upper flange 210 of horizontal tracks 88 and track radiuses 208 during partial movement of the door panels 16, and along upper flange 224 of short radius members 222 during the rest of the movement of the door panel 16*a* toward the top of the door frame 202. In particular, as the door panels 16 move to the vertical or closed position, the rollers 244 of follower members 240 transition from the upper flanges 210 to the upper flanges 224 near the point where the uppermost rollers 20*a* travel through the openings 232 in track radiuses 208. As the rollers 244 travel along upper flanges 224, the follower members 240 carry the uppermost rollers 20*a* through the channels 230 in the short radius members 222 to near the top of the door frame 202. Likewise, as the door panels 16 move to the horizontal or open position, the rollers 244 of follower members 240 transition from the upper flanges 224 to the upper flanges 210 near the point where the uppermost rollers 20*a* travel through the openings 232 in track radiuses 208.

To facilitate installation of the short radius members 222 in the universal overhead door system 200, each short radius member 222 preferably includes a series of apertures 254 (FIG. 11) that are shaped and aligned to receive the guide members 110 (FIGS. 7 and 8) that extend from the horizontal support rails 106. Preferably, as best understood with reference to FIG. 11, each of the apertures 254 includes an opening 256 sized slightly larger than the retaining element 114 of guide member 110 (FIGS. 7 and 8), and a pair of diametrically opposite slots 258 that extend from the opening 256 and are sized slightly smaller than the retaining element 114 but slightly larger than the webs 116. As the horizontal rail 106 and short radius members 222 are translated relative to each other, the retaining elements 114 engage and capture part of the short radius members 222 between the retaining elements and the vertical surface 120 of the horizontal rails 106. Short radius members 222 preferably have the same cross-sectional profile (not shown) as the track radiuses 90 discussed in detail above with reference to FIGS. 11A and 10B for accommodating changes in material thickness of the short radius members.

It is contemplated that for most garage door installations, the universal overhead door system 200 may include horizontal rails 106, horizontal tracks 88 and vertical tracks 92 of a standard size. Track radiuses 208, having a standard 15" radius, for example, may be used to connect the horizontal tracks 88 and vertical tracks 92. To accommodate for smaller door size openings or low head room environments, the short radius members 222 may be installed with sections 238 removed from the track radiuses 208. The length of the vertical tracks 92 can be shortened to accommodate the smaller door opening sizes. Thus, the ability to convert the track radiuses 208 by removing sections 238, and the ability to install the short radius members 222 when needed for smaller door opening sizes and low head room environments, provides a universal track system for most garage door installations.

Those skilled in the art will readily appreciate that the connection system of the present invention is relatively easy to manufacture, and provides rapid interconnection of garage door components. The present invention further provides a universal overhead door system that is modular and easily configurable to accommodate for different door opening sizes and low head room environments.

From the above disclosure of the general principles of the present invention and the preceding detailed description of preferred embodiments, those skilled in the will readily comprehend the various modifications to which the present invention is susceptible. The invention in its broader aspects is therefore not limited to the specific details and illustrative example shown and described. Accordingly, departures may be made from such details without departing from the spirit or scope of Applicants' general inventive concept. Therefore, Applicants desire to be limited only by the scope of the following claims and equivalents thereof:

Having described the invention, we claim:

1. A universal overhead door system, comprising:

an overhead door having a plurality of pivotally interconnected door panels operable to move between vertical and horizontal positions relative to a door frame, each of said door panels having guide members arranged on opposite sides thereof;

a pair of generally channel-shaped horizontal track members, each of said horizontal track members defining a generally horizontal channel for guiding movement of said guide members in a generally horizontal plane;

a pair of generally channel-shaped vertical track members, each of said vertical track members defining a generally vertical channel for guiding movement of said guide members in a generally vertical plane;

a pair of generally channel-shaped first radius members, each of said first radius members substantially abutting a respective end of said horizontal track members and extending in a defined radius of curvature to substantially abut respective ends of said vertical track members to thereby form a pair of substantially continuous door tracks on opposite sides of said door frame, each of said first radius members defining a first curved channel for guiding movement of said guide members between said horizontal and vertical channels, and further having an opening to permit uppermost ones of said guide members on opposite sides of said overhead door to travel outside of said first curved channels; and a pair of generally channel-shaped second radius members, each of said second radius members defining a second curved channel removably registrable with and extending directly from the opening in said first curved channels for guiding movement of said uppermost guide members into and out of said first curved channels during movement of said overhead door between said vertical and horizontal positions.

2. The overhead door system of claim 1 wherein said guide members comprise rollers extending from axles supported by said door panels.

3. The overhead door system of claim 2 wherein said axles are rotatably supported by roller brackets mounted to said door panels.

4. The overhead door system of claim 1 wherein said second radius members have a greater radius of curvature than said first radius members.

5. The overhead door system of claim 1 further comprising follower members connected to said uppermost guide members wherein said uppermost guide members are carried by said follower members during at least partial movement of said overhead door between said vertical and horizontal positions.

6. The overhead door system of claim 5 wherein said follower members are connected to said guide members through linkage members.

7. The overhead door system of claim 6 wherein said guide members comprise rollers extending from axles supported by said door panels, and said follower members comprise rollers connected to said axles through said linkage members.

8. The overhead door system of claim 5 wherein said follower members are operable to travel along an upper surface of said second radius members during movement of said overhead door between said vertical and horizontal positions.

9. The overhead door system of claim 1 wherein said first radius members are interchangeable with a pair of first radius members having a different defined radius of curvature.

10. The overhead door system of claim 1 wherein said first radius members include a section that may be selectively removed to define said openings.

11. A universal overhead door system, comprising:

an overhead door having a plurality of pivotally interconnected door panels operable to move between vertical and horizontal positions relative to a door frame, each of said door panels having guide members arranged on opposite sides thereof;

a pair of generally channel-shaped vertical track members, each of said vertical track members defining a generally vertical channel for guiding movement of said guide members in a generally vertical plane;

a pair of generally channel-shaped horizontal track members having integral first radius members which extend in a defined radius of curvature to substantially abut respective ends of said vertical track members to thereby form a pair of substantially continuous door tracks on opposite sides of said door frame, each of said horizontal track members defining a generally horizontal channel for guiding movement of said guide members in a generally horizontal plane and each of said integral first radius members defining a first curved channel for guiding movement of said guide members between said horizontal and vertical channels, said integral first radius members further having an opening to permit uppermost ones of said guide members on opposite sides of said overhead door to travel outside of said first curved channels; and a pair of generally channel-shaped second radius members, each of said second radius members defining a second curved channel removably registrable with and extending directly from the opening in said first curved channels for guiding movement of said uppermost guide members into and out of said first curved channels during movement of said overhead door between said vertical and horizontal positions.

12. The overhead door system of claim 11 further comprising follower members connected to said uppermost guide members wherein said uppermost guide members are carried by said follower members during at least partial movement of said overhead door between said vertical and horizontal positions.

13. The overhead door system of claim 12 wherein said follower members are connected to said guide members through linkage members.

14. The overhead door system of claim 13 wherein said guide members comprise rollers extending from axles supported by said door panels, and said follower members comprise rollers connected to said axles through said linkage members.

15. The overhead door system of claim 12 wherein said follower members are operable to travel along an upper surface of said second radius members during movement of said overhead door between said vertical and horizontal positions.

16. The overhead door system of claim 11 wherein said integral first radius members include a section that may be selectively removed to define said openings.

17. A universal overhead door system, comprising:

an overhead door having a plurality of pivotally interconnected door panels operable to move between vertical and horizontal positions relative to a door frame, each of said door panels having guide members arranged on opposite sides thereof;

a pair of support rails, each mounted to and extending generally horizontally from a respective side of said door frame;

a pair of generally channel-shaped horizontal track members mounted respectively to said pair of support rails, each of said horizontal track members defining a generally horizontal channel for guiding movement of said guide members in a generally horizontal plane;

a pair of generally channel-shaped vertical track members mounted respectively to opposite sides of said door frame, each of said vertical track members defining a generally vertical channel for guiding movement of said guide members in a generally vertical plane;

a pair of generally channel-shaped first radius members mounted respectively to said pair of support rails, each of said first radius members substantially abutting a respective end of said horizontal track members and extending in a defined radius of curvature to substantially abut respective ends of said vertical track members to thereby form a pair of substantially continuous door tracks on opposite sides of said door frame, each of said first radius members defining a first curved channel for guiding movement of said guide members between said horizontal and vertical channels, and further having an opening to permit uppermost ones of said guide members on opposite sides of said overhead door to travel outside of said first curved channels; and a pair of generally channel-shaped second radius members mounted respectively to said pair of support rails, each of said second radius members defining a second curved channel removably registrable with and extending directly from the opening in said first curved channels for guiding movement of said uppermost guide members into and out of said first curved channels during movement of said overhead door between said vertical and horizontal positions.

18. The overhead door system of claim 17 wherein said guide members comprise rollers extending from axles supported by said door panels.

19. The overhead door system of claim 18 wherein said axles are rotatably supported by roller brackets mounted to said door panels.

20. The overhead door system of claim 17 wherein said second radius members have a greater radius of curvature than said first radius members.

21. The overhead door system of claim 17 further comprising follower members connected to said uppermost guide members wherein said uppermost guide members are carried by said follower members during at least partial movement of said overhead door between said vertical and horizontal positions.

22. The overhead door system of claim 21 wherein said follower members are connected to said guide members through linkage members.

23. The overhead door system of claim 22 wherein said guide members comprise rollers extending from axles supported by said door panels, and said follower members comprise rollers connected to said axles through said linkage members.

24. The overhead door system of claim 21 wherein said follower members are operable to travel along an upper surface of said second radius members during movement of said overhead door between said vertical and horizontal positions.

25. The overhead door system of claim 17 wherein said first radius members are interchangeable with a pair of first radius members having a different defined radius of curvature.

26. The overhead door system of claim 17 wherein one of said pair of support rails and said pair of second radius members has a plurality of retaining members extending from a plane thereof and the other one pair has a plurality of apertures shaped and aligned to receive said retaining members upon registration of said support rails and second radius members in face-abutting relationship, said support rails and second radius members being operable to establish a connection therebetween upon translation of said support rails and second radius members relative to each other.

27. The overhead door system of claim 26 wherein each of said retaining members includes a retaining element that is offset from the plane of said one pair of support rails and said pair of second radius members.

28. The overhead door system of claim 27 wherein each of said retaining elements is substantially parallel to the plane of said one pair of support rails and said pair of second radius members.

29. The overhead door system of claim 27 wherein the offset of said retaining element is substantially constant independent of a change in material thickness of said other pair of support rails and said pair of second radius members.

30. The overhead door system of claim 26 wherein each of said retaining members comprises a retaining element which is offset from and substantially parallel to the plane of said one pair of support rails and said pair of second radius members, and a pair of diametrically opposite webs which join said retaining element with said one pair of support rails and said pair of second radius members.

31. The overhead door system of claim 30 wherein each of said retaining elements is substantially circular in configuration.

32. The overhead door system of claim 30 wherein each of said plurality of apertures comprises an opening sized slightly larger than said retaining element of said retaining member and a pair of diametrically opposite slots which extend from said opening and are sized slightly smaller than said retaining element.

33. An overhead door system, comprising:

an overhead door having a plurality of pivotally interconnected door panels operable to move between vertical and horizontal positions relative to a door frame, each of said door panels having guide members arranged on opposite sides thereof and follower members connected to said guide members;

a pair of generally channel-shaped door tracks mounted on respective sides of said door frame, each of said door tracks defining a substantially continuous channel for guiding movement of said guide members during movement of said overhead door between said vertical and horizontal positions and further having an opening to permit uppermost ones of said guide members on opposite sides of said overhead door to travel outside of said channels; and a pair of radius members in removable registry with and extending directly from the opening in said channels for guiding movement of said follower members and thereby guiding said uppermost guide members into and out of said channels during movement of said overhead door between said vertical and horizontal positions.

34. The overhead door system of claim 33 wherein said follower members are connected to said guide members through linkage members.

35. The overhead door system of claim 34 wherein said guide members comprise rollers extending from axles supported by said door panels, and said follower members comprise rollers connected to said axles through said linkage members.

36. The overhead door system of claim 33 wherein said follower members are operable to travel along an upper surface of said radius members during movement of said overhead door between said vertical and horizontal positions.

37. The overhead door system of claim 36 wherein said uppermost guide members are carried by said follower members during at least partial movement of said overhead door between said vertical and horizontal positions.

* * * * *